United States Patent [19]

Kobayashi et al.

[11] 4,291,643

[45] Sep. 29, 1981

[54] DEVELOPING APPARATUS IN A MAGNIFICATION-VARIABLE COPIER

[75] Inventors: Yuochi Kobayashi, Yokohama; Shinichi Kamiyama, Kawasaki, both of Japan

[73] Assignee: Ricoh Co., Ltd., Tokyo, Japan

[21] Appl. No.: 970,982

[22] Filed: Dec. 19, 1978

[30] Foreign Application Priority Data

Dec. 19, 1977 [JP] Japan ..... 52-152582

[51] Int. Cl.[3] ..... B05C 11/00; G03G 15/10

[52] U.S. Cl. ..... 118/669; 118/647; 118/672; 355/10

[58] Field of Search ..... 427/15, 17; 118/647–651, 669, 672; 96/1 R; 430/103; 355/10

[56] References Cited

U.S. PATENT DOCUMENTS

| | | | |
|---|---|---|---|
| 3,638,610 | 2/1972 | Lyles et al. | 118/647 |
| 3,708,161 | 1/1973 | Lux et al. | 271/9 |
| 3,784,301 | 1/1974 | Sato | 355/7 |
| 3,822,670 | 7/1974 | Sato et al. | 118/651 |
| 4,006,709 | 2/1977 | Miyakawa et al. | 118/648 |

*Primary Examiner*—Evan K. Lawrence

*Attorney, Agent, or Firm*—Oblon, Fisher, Spivak, McClelland & Maier

[57] ABSTRACT

An apparatus for the development of an electrostatic latent image in a magnification-variable copier which is capable of preventing the development of black frames on the outer circumference of copying portion when the reproduction is to be performed on a reduced scale. For this purpose, the apparatus includes a developing electrode which is divided into a plurality of units, such that a proper biasing potential is applied to the copying portion, and a high biasing potential is applied to other portions, whereby the developing is not effected for the unnecessary portions.

6 Claims, 7 Drawing Figures

DEVELOPING APPARATUS IN A MAGNIFICATION-VARIABLE COPIER

BACKGROUND OF THE INVENTION

1. Field of the Invention

The present invention relates to a developing apparatus in a copier, and more specifically to an apparatus for developing an electrostatic latent image in a magnification-variable copier.

2. Description of the Prior Art

According to conventional copiers capable of effecting reproduction on a reduced scale, it has been attempted to prevent the development of black frames on portions other than the copying portions reproduced on a reduced scale by irradiating light from a separate source of light onto the portions which do not correspond to the reduced size of the photosensitive member, thereby to reduce the charging potential of such portions so that no developing is carried out. With such a method, however, it has been necessary to provide a separate source of light, it has been required that the separate source of light cause no disturbance for reproduction on an equal scale or on an enlarged scale, and it has been necessary to provide a shield such that the separate source of light not affect the reproducing areas. Therefore, the arrangement of each of such devices has been greatly limited, causing the resulting apparatus to become complex in construction.

SUMMARY OF THE INVENTION

A first object of the present invention is to inhibit the developing on unnecessary portions even when the size of a copying paper is greater than the size of the reproduction that is to be performed on a reduced scale.

A second object of the present invention is to simply construct means which inhibits the developing on unnecessary portions.

A third object of the present invention is to inhibit the developing on unnecessary portions by a simplified manner not only when the scale of the reproduction is changed to a predetermined magnification but also when the scale of the reproduction is changed in a continuous manner.

A fourth object of the present invention is to inhibit the development on unnecessary portions even when the biasing voltage is changed responsive to the potential of an electrostatic latent image.

DESCRIPTION OF THE PREFERRED EMBODIMENTS

Figure 1:
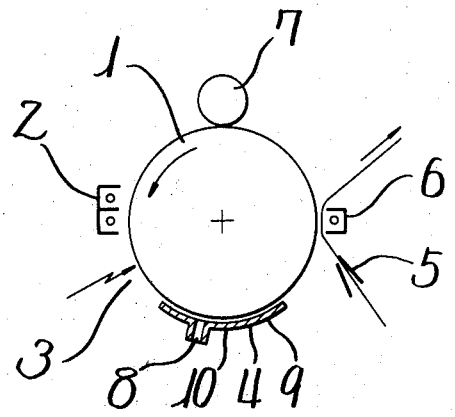
FIG. 1 is a vertical cross-sectional view showing an embodiment according to the present invention.
Figure 2:
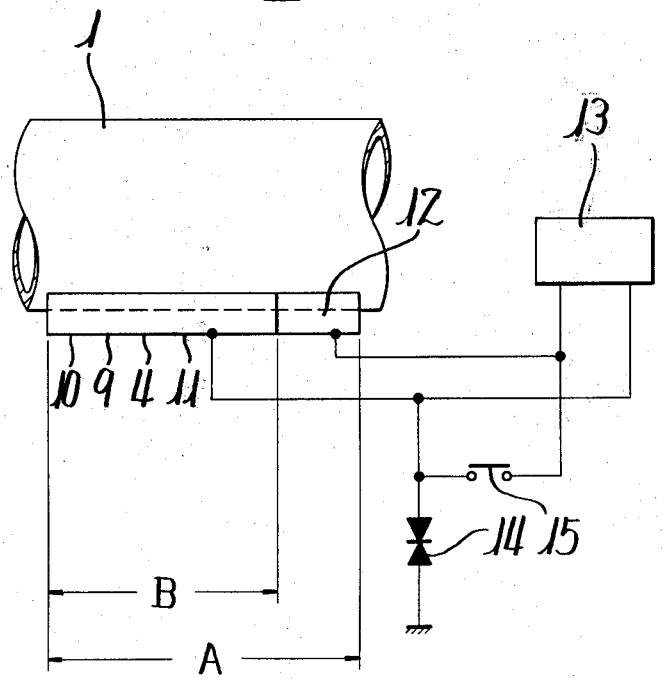
FIG. 2 is a partial front view showing electrical connection.

A first embodiment of the present invention is mentioned below with reference to FIGS. 1 and 2. First, a cylindrical photosensitive member 1 is rotatably provided. Around the periphery of the photosensitive member 1 are disposed an electric charger 2, an optically exposing portion 3, a developing portion 4, a paper-feeding portion 5, a transfer charger 6, and a cleaning portion 7. The developing portion is located below the photosensitive member 1, and is composed of a developing dish 9 having a developing liquid-feeding port 8 through which will be fed a developing liquid. The developing dish 9 is electrically conductive and serves as a developing electrode 10. The developing electrode 10 has a length which corresponds to a maximum copying size A, and is electrically divided into two portions: an electrode 11 of a length corresponding to a copying size B of a reduced scale and an electrode 12 to cover the excess portions. The electrode 11 is connected to a biasing power supply 13, and a constant-voltage element 14 is connected between the electrode 11 and ground so that a biasing potential necessary for development is applied to the electrode 11. The electrode 12 is also connected to the biasing power supply 13 such that a biasing voltage greater than the surface potential of the photosensitive member 1 is applied to the electrode 12. A switch 15 for switching the biasing voltage is connected between the electrode 11 and the electrode 12.

Being so constructed, when the reproduction is to be effected with a maximum width, a switch 15 is turned on, so that the same biasing potential is applied to the electrode 11 and the electrode 12. When the reproduction is to be effected on a reduced scale, the switch 15 is turned off, whereby a biasing potential necessary for the developing is applied to the electrode 11, and a biasing potential greater than the surface potential of the photosensitive member 1 is applied to the electrode 12. Therefore, the developing is effected only for the portions corresponding to the reproduction size B of the reduced scale, and no developing is effected for other portions.

Here, although not diagramatized, in effecting the reproduction on a reduced scale, it is also possible to electrically float the electrode 12 by utilizing a potential induced on the developing electrode 10 by the surface potential of the photosensitive member 1.

Figure 3:
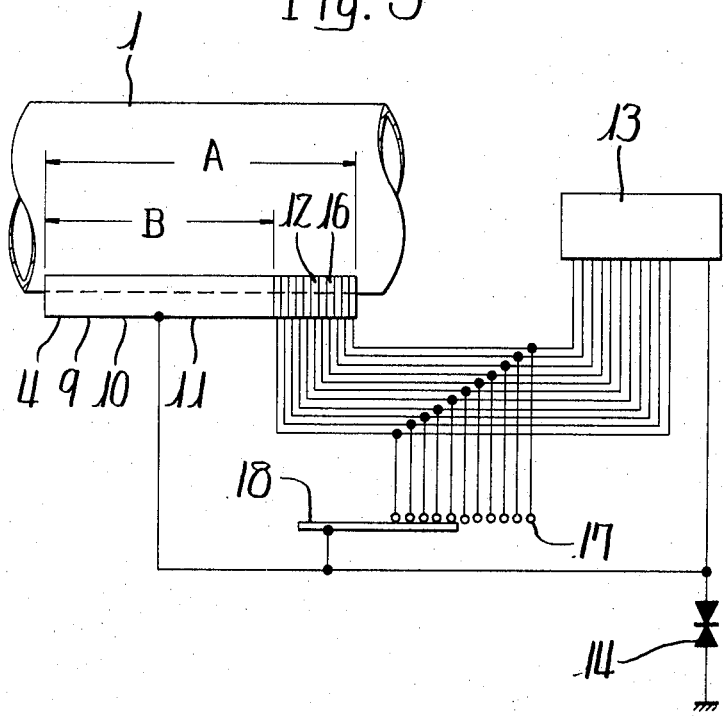
FIG. 3 is a front view showing a second embodiment of the present invention.
Figure 4:
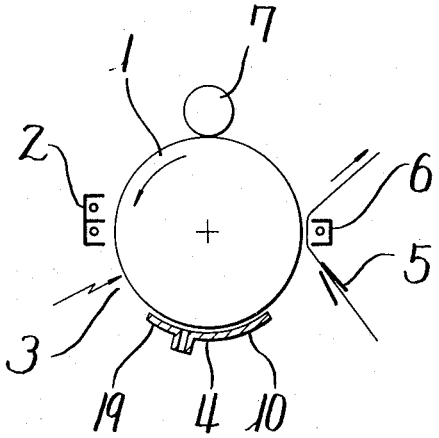
FIG. 4 is a vertical cross-sectional view showing a third embodiment of the present invention.
Figure 5:
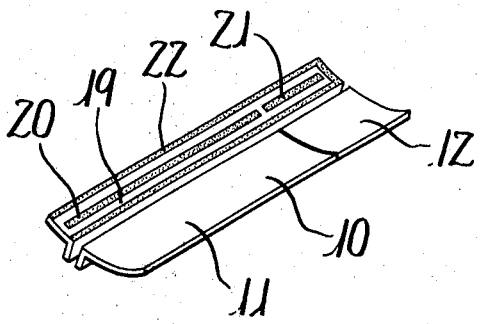
FIG. 5 is a perspective view showing a developing dish.
Figure 6:
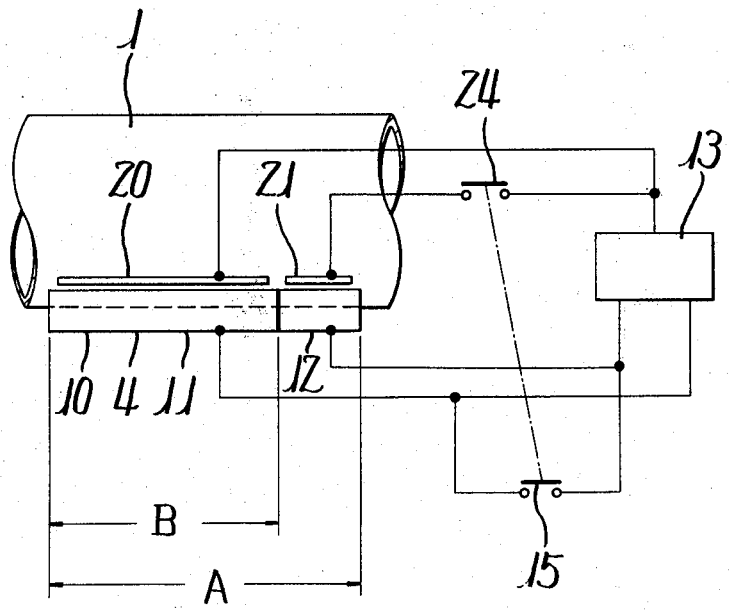
FIG. 6 is a partial front view showing electrical connection.
Figure 7:
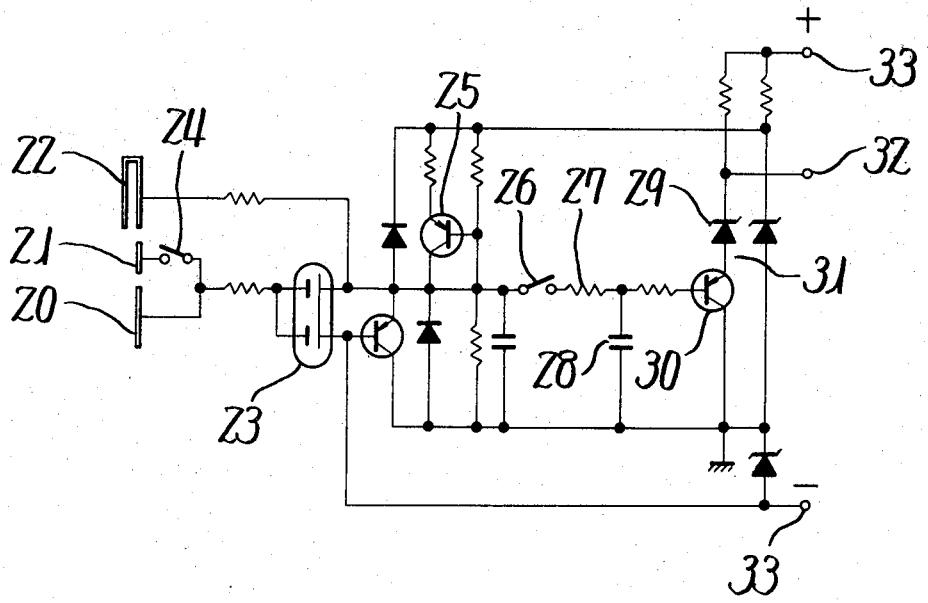
FIG. 7 is a diagram showing an auto-biasing circuit.

A second embodiment of the present invention is described below with reference to FIG. 3, in which the same portions as those of the first embodiment are denoted by the same reference numerals, and their description is omitted. In this embodiment, the electrode 12 is divided into many slim electrodes 16 that are electrically insulated from each other, and each of the slim electrodes 16 is connected to the biasing power supply 13. Contact points 17 are drawn from each of the slim electrodes 16 and are disposed in alignment. A slide contact plate 18 connected the electrode 11 is so provided that the connection is successively made with respect to these contact points 17 starting from the side of the small electrode 11.

Therefore, a minimum copying size corresponds to the width of the electrode 11; the copying size is allowed to be magnified arbitrarily from the minimum size to a maximum size in a continuous manner, without producing developing on the unnecessary portions. That is, by moving the slide contact plate 18, a biasing potential the same as that of the electrode 11 is applied to the slim electrodes 16 whose contact points 17 are brought into contact with the slide contact plate 18, while other slim electrodes 16 acquire a higher biasing potential. Therefore, no developing is effected on the surface of the photosensitive member 1 to which are faced the slim electrodes 16 acquiring a higher potential.

A third embodiment of the present invention is illustrated below with reference to FIG. 4 to FIG. 7. The aforementioned two embodiments were based on a so-called fixed biasing method. The third embodiment is based on an auto-biasing method. The developing dish 9 has a sensor portion 19 at the front and a developing electrode 10 at the rear. The developing electrode 10 is divided into an electrode 11 and an electrode 12. The sensor portion 19 has a sensor electrode 20 of a width corresponding to the small electrode 11, and a sensor electrode 21 of a width corresponding to the electrode 12. Around these sensor electrodes 20 and 21 is provided a protector electrode 22 to prevent the effect of the developing electrode 10.

The sensor electrode 20 is directly connected to an amplifier unit 23 consisting of a field effect transistor, and the sensor electrode 21 is also connected to the amplifier unit 23 via a selection switch 24. The protector electrode 22 is connected to the output side of the amplifier unit 23. The output side of the amplifier unit 23 is further connected to a sensor switch 26 via a constant-current circuit including a transistor 25, to a resistor 27 and to a capacitor 28 which will be electrically charged depending upon the output of the amplifier unit 23. The capacitor 28 is connected to an output circuit 31 composed of a Zener diode 29 and a transistor 30, and the output terminal 32 of the output circuit 31 is connected to the electrode 11. Reference numeral 33 represents a terminal of the power supply.

With the thus constructed setup, the electrostatic latent image formed on the photosensitive member 1 while it is rotated, is detected for its potential by the sensor portion 19, and a biasing potential is applied to the developing electrode responsive to the thus detected potential. In this case, the sensor electrodes 20, 21 are selected by means of the selection switch 24. Therefore, the portions on which are formed the pictures are detected even when the reproduction is effected on the same scale or on a reduced scale, enabling the biasing potential to be very accurately determined as compared with the case when the sensor portion 19 is not divided.

What is claimed is:

1. An apparatus for the development of an electrostatic latent image in a magnification-variable copier, comprising:

a photosensitive surface movable along a predetermined path;

latent image forming means for forming an electrostatic latent image to be transferred to a copying medium on said photosensitive surface;

developing electrode means located in an opposed relationship to said photosensitive surface for developing said electrostatic latent image formed on said photosensitive surface, said developing electrode means having a length sufficient to develop a full size copy, said developing electrode means including a plurality of electrode segments, each of said plurality of electrode segments being electrically insulated from each other, said plurality of electrode segments being serially arranged in a row, said row being parallel to the direction of width of said photosensitive surface and perpendicular to a direction of travel of a copying medium passing through said copier, said plurality of electrode segments being divided into a first electrode portion consisting of one electrode segment and a second electrode portion consisting of at least one electrode segment, said first electrode portion having a length sufficient for the development of a reduced size copy, said second electrode portion having a length sufficient for the development of the excess copy area between the full size copy and the reduced size copy;

biasing potential supply means for supplying first and second biasing potentials, said first biasing potential being the potential necessary for the development of said electrostatic latent image, said second biasing potential being a potential greater than the surface potential of said photosensitive surface such that development of said electrostatic latent image is prevented, said biasing potential supply means being coupled to supply said first biasing potential to said first electrode portion; and biasing switching means coupled between said biasing potential supply means and said second electrode portion for selectively coupling one of said first or second biasing potentials to said second electrode portion;

whereby said biasing switching means couples said first biasing potential to said second electrode portion when a full size copy is to be made on said copying medium by said copier and couples said second biasing potential to said second electrode portion where a reduced size copy is to be made on said copying medium by said copier.

2. An apparatus for the development of an electrostatic latent image in a magnification-variable copier as recited in claim 1, wherein:

said second electrode portion consists of a single electrode segment.

3. An apparatus for the development of an electrostatic latent image in a magnification-variable copier as recited in claim 1, wherein:

said first electrode portion is longer than said second electrode portion.

4. An apparatus for the development of an electrostatic latent image in a magnification-variable copier as recited in claim 1, which further comprises:

means coupled to said second electrode portion for electrically floating said second electrode portion and for causing said second electrode portion to reach a potential induced by the surface potential occurring on said photosensitive surface.

5. An apparatus for the development of an electrostatic latent image in a magnification-variable copier, comprising:

a photosensitive surface movable along a predetermined path;

latent image forming means for forming an electrostatic latent image to be transferred to a copying medium on said photosensitive surface;

developing electrode means located in an opposed relationship to said photosensitive surface for developing said electrostatic latent image formed on said photosensitive surface, said developing electrode means having a length sufficient to develop a full size copy, said developing electrode means including a plurality of electrode segments, each of said plurality of electrode segments being electrically insulated from each other, said plurality of electrode segments being serially arranged in a row, said row being parallel to a direction of width of said photosensitive surface and perpendicular to a direction of travel of a copying medium passing through said copier, said plurality of electrode segments being divided into a first electrode portion consisting of one electrode segment and a second electrode portion consisting of a plurality of electrode segments, said first electrode portion having a length sufficient for the development of a minimum reduced size copy, said second electrode portion having a length sufficient for the development of the excess copy area between the full size copy and the minimum reduced size copy;

biasing potential supply means for supplying first and second biasing potentials, said first biasing potential being the potential necessary for the development of said electrostatic latent image, said second biasing potential being a potential greater than the surface potential of said photosensitive surface such that development of said electrostatic latent image is prevented, said biasing potential supply means being coupled to supply said first biasing potential to said first electrode portion; and biasing switching means coupled between said biasing potential supply means and said second electrode portion for selectively coupling one of said first or said second biasing potentials to each of said plurality of electrode segments in said second electrode portion;

whereby said biasing switching means couples said first biasing potential to each of said plurality of electrode segments in said second electrode portion when a full size copy is to be made on said copying medium by said copier; and whereby said biasing switching means couples said first biasing potential to a first group of said plurality of electrode segments in said second electrode portion and couples said second biasing potential to a second group of said plurality of electrode segments in said second electrode portion when a reduced size copy is to be made on said copying medium by said copier.

6. An apparatus for the development of an electrostatic latent image in a magnification-variable copier, comprising:

a photosensitive surface movable along a predetermined path;

latent image forming means for forming an electrostatic latent image to be transferred to a copying medium on said photosensitive surface;

developing electrode means located in an opposed relationship to said photosensitive surface for developing said electrostatic latent image formed on said photosensitive surface, said developing electrode means having a length sufficient to develop a full size copy, said developing electrode means including a plurality of electrode segments, each of said plurality of electrode segments being electrically insulated from each other, said plurality of electrode segments being serially arranged in a row, said row being parallel to the direction of width of said photosensitive surface and perpendicular to a direction of travel of a copying medium passing through said copier, said plurality of electrode segments being divided into a first electrode portion consisting of one electrode segment and a second electrode portion consisting of at least one electrode segment, said first electrode portion having a length sufficient for the development of a reduced size copy, said second electrode portion having a length sufficient for the development of the excess copy area between the full size copy and the reduced size copy;

sensor means located in an opposed relationship to said photosensitive surface for detecting an electrostatic potential of said electrostatic latent image formed on said photosensitive surface and for producing an output signal representative of said electrostatic potential of said electrostatic latent image;

biasing potential supply means coupled to receive said output signal from said sensor means for supplying first and second biasing potentials, said first biasing potential being controlled by said output signal from said sensor means, said first biasing potential being the potential necessary for the development of said electrostatic latent image, said second biasing potential being a potential greater than the surface potential of said photosensitive surface such that development of said electrostatic latent image is prevented, said biasing potential supply means being coupled to supply said first biasing potential to said first electrode portion; and biasing switching means coupled between said biasing potential supply means and said second electrode portion for selectively coupling one of said first or second biasing potentials to said second electrode portion;

whereby said biasing switching means couples said first biasing potential to said second electrode portion when a full size copy is to be made on said copying medium by said copier and couples said second biasing potential to said second electrode portion when a reduced size copy is to be made on said copying medium by said copier.

* * * * *